United States Patent [19]

Jahn

[11] 4,100,851

[45] Jul. 18, 1978

[54] DEVICE FOR ADJUSTING LATERAL AND CIRCUMFERENTIAL REGISTRY IN ROTARY PRINTING MACHINES

[75] Inventor: Hans-Georg Jahn, Wiesenbach, Fed. Germany

[73] Assignee: Heidelberger Druckmaschinen Aktiengesellschaft, Heidelberg, Fed. Germany

[21] Appl. No.: 846,848

[22] Filed: Oct. 31, 1977

[30] Foreign Application Priority Data

Oct. 30, 1976 [DE] Fed. Rep. of Germany ..... 7634679

[51] Int. Cl.[2] ..... B41F 13/14

[52] U.S. Cl. ..... 101/248

[58] Field of Search ..... 101/248, 181; 74/840, 74/395; 83/471.3, 473, 477.1, 497, 499

[56] References Cited

U.S. PATENT DOCUMENTS

| | | | |
|---|---|---|---|
| 2,002,584 | 5/1935 | Rawson | 101/248 |
| 2,539,068 | 1/1951 | Funk | 101/248 |
| 3,750,568 | 8/1973 | Weisgerber | 101/248 |

FOREIGN PATENT DOCUMENTS

| | | | |
|---|---|---|---|
| 1,239,323 | 4/1967 | Fed. Rep. of Germany | 101/248 |
| 1,561,066 | 5/1971 | Fed. Rep. of Germany | 101/248 |

*Primary Examiner*—J. Reed Fisher
*Attorney, Agent, or Firm*—Herbert L. Lerner

[57] ABSTRACT

In a rotary printing machine having a plate cylinder journalled at opposite ends thereof in a respective bearing and having a helical drive gear for the plate cylinder mounted on the journal thereof, a device for adjusting lateral register by axial shifting of the plate cylinder and for adjusting circumferential register by axial shifting of the helical drive gear, the device includes adjusting members disposed so as to act coaxially upon at least one of the plate cylinder and the drive gear therefor, the adjusting members including a sliding bushing disposed in each bearing of the plate cylinder, a toothed rim threadedly adjustable at each of the plate-cylinder bearings and connected to the respective sliding bushing, and a respective worm spindle meshingly engaging the toothed rim, a disc member secured to the plate-cylinder journal at one of the bearings, and first thrust bearing means engageable with the disc, the sliding bushing at the one bearing being adjustable so as to bear through the first thrust bearing means against the disc for effecting lateral register adjustment, the helical drive gear being mounted for sliding on the journal at the other of the bearings, an entrainer disc also mounted on the journal at the other of the bearings, compression spring means for bracing the helical drive gear against the entrainer disc, and second thrust bearing means engageable with the helical drive gear, the sliding bushing at the other bearing being adjustable so as to bear through the second thrust bearing means against the helical drive gear for effecting circumferential register adjustment.

2 Claims, 2 Drawing Figures

Figure 1:
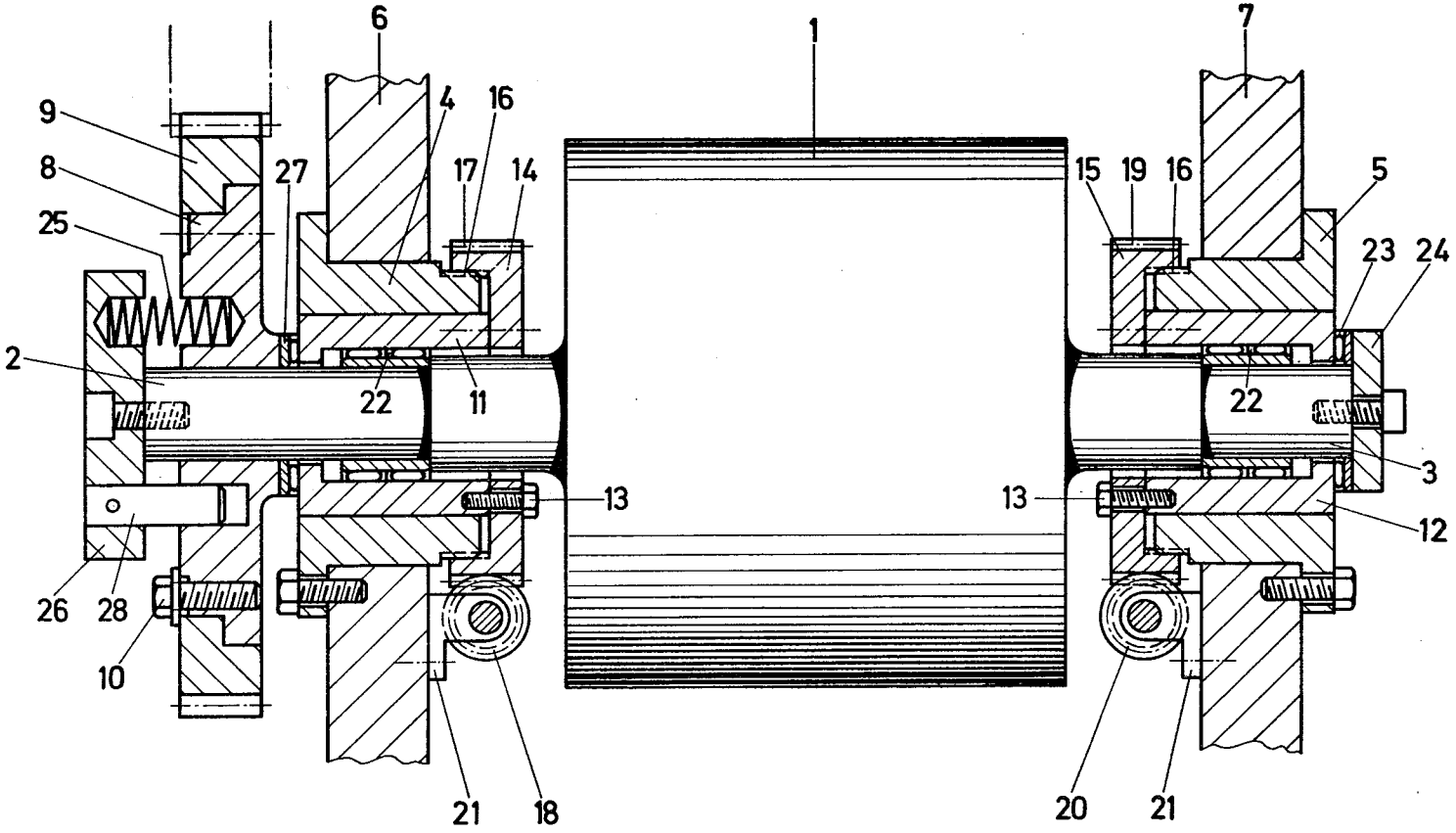

DEVICE FOR ADJUSTING LATERAL AND CIRCUMFERENTIAL REGISTRY IN ROTARY PRINTING MACHINES

The invention relates to a device in rotary printing machines for adjusting lateral register by axial shifting of the plate cylinder and for adjusting circumferential register by axial shifting of a helical drive gear of the plate cylinder by means of adjusting members which act coaxially or concentrially upon the plate cylinder and/or upon the drive gear for the cylinder.

An heretofore known device of this general type (German Patent DT-PS 1,239,323) also permits lateral and circumferential register adjustment but, for this purpose, requires expensive construction. Furthermore, in this prior-art device, the adjusting screwthreads are not based directly on the side frames of the printing machine, but are braced on covers bolted to the side walls. Through the forces that are produced, especially during the running or operation of the machine, no vibration-free bracing of the adjusting members is afforded by this device, which can lead to register differences in the printing.

Another heretofore known construction (German Patent DT-PS 1,561,066) provides adjustment of lateral and circumferential register, the adjusting screwthreads of this construction being likewise braced in a separate housing. Moreover, this heretofore known construction has the disadvantage that both adjusting operations must be carried out on the drive side of the machine. The operating personnel must therefore change-over from the operating side to the drive side if the lateral or circumferential register has to be adjusted.

It is accordingly an object of the invention to provide a lateral and circumferential register-adjustment device, especially for sheet-fed offset printing machines of small formats, which is braced or supported directly at the side frames of the respective machine, can be produced in a simple and economical manner and permits separate adjustment of the lateral and circumferential register during operation of the machine.

With the foregoing and other objects in view, there is provided, in accordance with the invention, in a rotary printing machine having a plate cylinder journalled at opposite ends thereof in a respective bearing and having a helical drive gear for the plate cylinder mounted on the journal thereof, a device for adjusting lateral register by axial shifting of the plate cylinder and for adjusting circumferential register by axial shifting of the helical drive gear, the device comprising adjusting members disposed so as to act coaxially upon at least one of the plate cylinder and the drive gear therefor, said adjusting members including a sliding bushing disposed in each bearing of the plate cylinder, a toothed rim threadedly adjustable at each of the plate-cylinder bearings and connected to the respective sliding bushing, and a respective worm spindle meshingly engaging said toothed rim, a disc member secured to the plate-cylinder journal at one of the bearings, and first thrust bearing means engageable with said disc, the sliding bushing at the one bearing being adjustable so as to bear through said first thrust bearing means against said disc for effecting lateral register adjustment, the helical drive gear being mounted for sliding on the journal at the other of the bearings, an entrainer disc also mounted on the journal at the other of the bearings, compression spring means for bracing the helical drive gear against said entrainer disc, and second thrust bearing means engageable with said helical drive gear, the sliding bushing at the other bearing being adjustable so as to bear through said second thrust bearing means against the helical drive gear for effecting circumferential register adjustment. This construction according to the invention provides a space-saving solution which is relatively inexpensive because of the use of largely identical parts and which meets the demands and requirements imposed thereon in an optimal and functionally reliable manner.

In case a positive or form-locking lateral register adjustment is desired, in accordance with another feature of the invention, the sliding bushing located at the one bearing and adjustable so as to bear through the first thrust bearing means against the disc for effecting lateral register adjustment is disposed around and embraces the disc, and the first thrust bearing means comprise two thrust bearings respectively disposed on opposite sides of the disc and bearable in both axial directions against the disc. The compression spring means thus then brace or support only the helical drive gear, which is shifted to effect circumferential register adjustment. The forces acting upon the compression spring means are thereby reduced.

The worm spindles are turned in a conventional manner by nonillustrated handwheels, which may be disposed directly on the worm spindles between the side frames of the machine. Through the interposition of two sets of bevel gears, for example, the handwheels for adjustment of the lateral and circumferential register may also be disposed on the operating side of the machine.

Other features which are considered as characteristic for the invention are set forth in the appended claims.

Although the invention is illustrated and described herein as embodied in device for adjusting lateral and circumferential registry in rotary printing machines, it is nevertheless not intended to be limited to the details shown, since various modifications and structural changes may be made therein without departing from the spirit of the invention and within the scope and range of equivalents of the claims.

Figure 2:
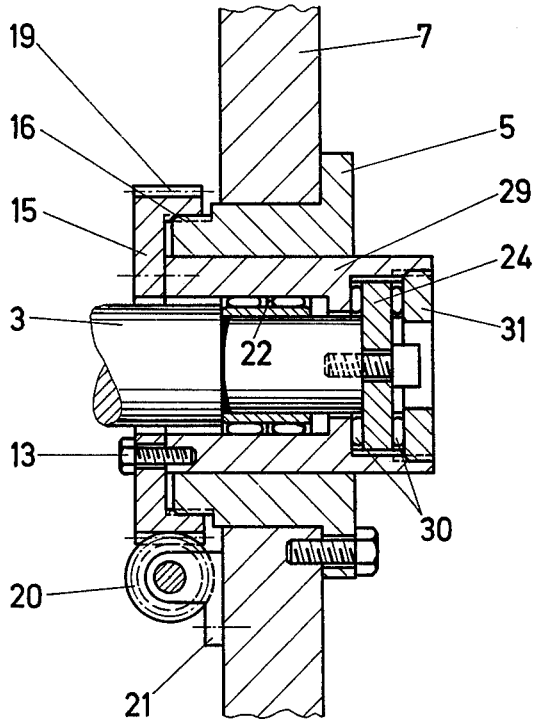

The construction and method of operation of the invention, however, together with additional objects and advantages thereof will be best understood from the following description of specific embodiments when read in connection with the accompanying drawings, in which:

FIG. 1 is a fragmentary longitudinal sectional view of the lateral and circumferential register adjustment device according to the invention, showing the essential features thereof; and FIG. 2 is a view similar to that of FIG. 1 showing only a modified form of the lateral register adjustment device thereof wherein the adjustment is positive or formlocking.

Referring now to the drawing and first, particularly, to FIG. 1 thereof, there is shown a plate cylinder 1 mounted by cylinder journals 2 and 3 therefor in side frames 6 and 7 of a printing machine with the aid of plate-cylinder bearings 4 and 5. On the cylinder journal 2, there is slidably mounted a helical drive gear 8 having a toothed rim 9 that is adjustable after loosening screws 10.

In the cylinder bearings 4 and 5 sliding bushings 11 and 12 are respectively disposed, connected by pins or screws 13 to a respective toothed rim 14, 15. Each toothed rim 14, 15 is formed with a screwthread 16 by which it is threadedly secured to a respective screwthread on the cylinder bearings 4 and 5. The worm spindle 18 meshingly engages the teeth 17 of the toothed rim 14, while the worm spindle 20 meshingly engages the teeth 19 of the toothed rim 15. The two worm spindles 18 and 20 are mounted in bearings 21 on the side frames 6 and 7, respectively.

When the worm spindle 20 is turned by means of a non-illustrated handwheel, the toothed rim 15 and consequently, also the sliding bushing 12 are turned. By means of the screwthread 16 on the toothed rim 15, the latter is axially shifted together with the sliding bushing 12, through the simultaneous rotation, so-called stick-slip effect is avoided. The cylinder journal 3 is mounted by means of needle bearings 22 in the sliding bushing 12. The axial movement of the sliding bushing 12 on the operating side of the machine effects a lateral register adjustment of the plate cylinder 1 by way of a thrust bearing 23 and a disc 24 fastened to the cylinder journal 3.

Counterpressure for the thrust bearing 23 and thus the pressure due to which it bears against the sliding bushing 12 and against the disc 24 is provided by compression springs 25, which are braced between a driver disc 26, which is fastened to the cylinder journal 2, and the drive gear 8 which, in turn, bears against the sliding bushing 11 through the thrust bearing 27 and is thus braced or supported on the side frame 6 through the toothed rim 14 and the cylinder bearing 4.

Upon the turning of the worm spindle 18 by means of a non-illustrated handwheel on the drive side of the printing machine, circumferential register is adjusted. In the same manner as on the operating side, this results in the turning and simultaneous axial shifting of the sliding bushing 11 through the action of the screwthread 16. Through the thrust bearing 27, this axial shift acts upon the drive gear 8 and shifts the latter on the cylinder journal 2. Due to the helical toothing of the drive gear 8, a rotation of the plate cylinder 1 in relation to a non-illustrated opposing cylinder of the machine is effected. Through this additional rotation, the circumferential register can be sensitively adjusted. The drive forces transmitted through the drive gear 8 to the plate cylinder 1 are transmitted through an entrainer pin 28, which is displaceably mounted in the drive gear 8, and through an entrainer disc 26 to the cylinder journal 2.

Thus, fine adjustment of lateral register can be achieved on the operating side of the machine though the worm spindle 20, and fine adjustment of circumferential register on the drive side through the worm spindle 18. These adjustments are effected without play, because the compression springs 25 ensure that the two thrust bearings 23 and 27 are always maintained in contact through the plate cylinder 1 and the two side frames 6 and 7. Furthermore, lateral and circumferential register adjustments are effected independently of one another.

FIG. 2 shows an embodiment of the invention wherein a sliding bushing 29 is disposed around and embraces the disc 24 and, by means of two thrust bearings 30, effects adjustment of lateral register in both axial directions. In this construction of FIG. 2, the thrust bearings 30 are adjusted free of play by means of a threaded disc 31 disposed in the sliding bushing 29. Upon turning the worm spindle 20 on the operating side of the machine, the lateral register adjustment is thus made positively or form-lockingly in both directions. The compression springs 25 on the drive side of the machine now need to be constructed only for adjustment of circumferentail register by means of the drive gear 8.

There are claimed:

1. In a rotary printing machine having a plate cylinder journalled at opposite ends thereof in a respective bearing and having a helical drive gear for the plate cylinder mounted on the journal thereof, a device for adjusting lateral register by axial shifting of the plate cylinder and for adjusting circumferential register by axial shifting of the helical drive gear, the device comprising adjusting members disposed so as to act coaxially upon at least one of the plate cylinder and the drive gear therefor, said adjusting members including a sliding bushing disposed in each bearing of the plate cylinder, a toothed rim threadedly adjustable at each of the plate-cylinder bearings and connected to the respective sliding bushing, and a respective worm spindle meshingly engaging each said toothed rim, a disc member secured to the plate-cylinder journal at one of the bearings, and first thrust bearing means engageable with said disc, the sliding bushing at the one bearing being adjustable so as to bear through said first thrust bearing means against said disc for effecting lateral register adjustment, the helical drive gear being mounted for sliding on the journal at the other of the bearings, an entrainer disc also mounted on the journal at the other of the bearings, compression spring means for bracing the helical drive gear against said entrainer disc, and second thrust bearing means engageable with said helical drive gear, the sliding bushing at the other bearing being adjustable so as to bear through said second thrust bearing means against the helical drive gear for effecting circumferential register adjustment.

2. Device for adjusting lateral and circumferential register according to claim 1 wherein said sliding bushing located at the one bearing and adjustable so as to bear through said first thrust bearing means against said disc for effecting lateral register adjustment is disposed around and embracing said disc, and said first thrust bearing means comprise two thrust bearings respectively disposed on opposite sides of said disc and bearable in both axial directions against said disc.

* * * * *